United States Patent [19]

Foresman

[11] Patent Number: 4,872,617

[45] Date of Patent: Oct. 10, 1989

[54] CANTED, SPRING-LOADED FEED SCREW SUPPORT

[75] Inventor: James D. Foresman, Hughesville, Pa.

[73] Assignee: Sprout-Bauer, Inc., Muncy, Pa.

[21] Appl. No.: 201,530

[22] Filed: Jun. 2, 1988

[51] Int. Cl.[4] ..... B02C 7/14

[52] U.S. Cl. ..... 241/247; 241/261.2; 241/285 R; 384/40

[58] Field of Search ..... 384/42, 40, 37; 241/101.2, 261.2, 261.3, 285 R, 247

[56] References Cited

U.S. PATENT DOCUMENTS 2,719,761 10/1955 Bonnafe ..... 384/42
3,847,359 11/1974 Holmes et al. .
4,688,732 8/1987 Jackson .
4,725,336 2/1988 Fisher .

FOREIGN PATENT DOCUMENTS 465493 6/1975 U.S.S.R. ..... 384/40

*Primary Examiner*—Mark Rosenbaum
*Attorney, Agent, or Firm*—Chilton, Alix & Van Kirk

[57] ABSTRACT

A feed screw housing support includes a support pedestal (46), a spring loaded tie rod assembly (76), and a bearing assembly including pedestal bearing blocks (62) cooperating with mating bearing blocks (66) connected directly or indirectly to the housing. The tie rod assembly provides a resilient hold down force between the housing (32) and the pedestal (46). The interfacing surfaces (74) of the blocks are angled in such a manner that, when viewed from the ends, a line extending from each planar interface of the blocks passes directly through the axis (54) of the feed screw rotor (28).

18 Claims, 3 Drawing Sheets

CANTED, SPRING-LOADED FEED SCREW SUPPORT

BACKGROUND OF THE INVENTION

The present invention relates generally to disc type attrition mills and more particularly to a disc type refiner having a refiner casing and an attached feed screw housing.

Disc refiners of this type are widely used in paper pulp processing and are characterized by a rotor supporting a concentric disc. A set of refining plates is mounted on one or both axial faces of the disc. The refining plates are available in a variety of patterns and plate faces typically are in a ribbed or toothed pattern. A stationary set of refiner plates is disposed in juxtaposed relation to the plates of the disc on the rotor, and the material to be refined is introduced near the rotor axis between the opposing plate surfaces. The relative rotation of the plates centrifugally advances the material radially across the plate surfaces and the relatively close spacing of the plates breaks down the material fibers. In a common embodiment of such disc type refiner, a screw or ribbon feeder is associated with the rotor, and extends in a housing which is rigidly connected to the refiner casing. Typically, another screw arrangement is connected to the feed screw housing to supply raw material from a storage bin.

The spacing between the rotating, or rotating and stationary plates, is typically in the range of 0.04 to 0.10 inches during the refining operation. A recurring problem with refiner of this type, is that external loads developed by thermal expansion of connecting pieces and pressure forces developed by flexible expansion joints associated with the housing and casing, have not been well isolated from the refiner casing. If such external loads on the feed screw housing are not isolated from the refiner casing, they can adversely effect the operation of the refiner by causing distortion of the refining surfaces and causing the refiner to go out of tram, i.e., base parallelism of the refining plates.

Conventional techniques for accommodating these external loads do not fully compensate for all directions of thermal expansion and externally applied piping loads. A typical prior art arrangement is shown in U.S. Pat. No. 3,847,359 (Holmes et al), "Disc Type Refiner With Automatic Plate Spacing Control", which discloses a rotor mounted in a bearing set, which in turn is mounted in a member that is slidably disposed within the housing to permit axial displacement of the bearing without changing the position of the rotor with respect to the base of the refiner. Although this arrangement can accommodate horizontal stresses, it can not readily accommodate vertical stresses.

U.S. Pat. No. 4,688,732 (Jackson), "Refiner With Improved Bearing Retainer Construction", also disclosed a bearing assembly which can accommodate displacement between a rotor and its enclosure, but, as with the previously mentioned patent, only in the axial, i.e., horizontal, direction.

SUMMARY OF THE INVENTION

It is thus an object of the present invention to provide support for a refiner feed screw, which will allow for expansion of the feed screw housing in all directions, and isolate a connected refiner both horizontally and vertically from external thermal expansion and piping loads applied to the feed screw housing.

It is a further object to provide such a support in a manner whereby the inlet feed conveyor can be positioned on either side or the top of the feed screw housing. This allows complete flexibility for equipment installations.

In accordance with the invention, the feed screw support includes a support pedestal, a spring loaded tie rod assembly, and a bearing assembly including pedestal bearing blocks cooperating with mating bearing blocks connected directly or indirectly to the housing. The tie rod assembly provides a resilient hold down force between the housing and the pedestal. The interfacing surfaces of the blocks are angled in such a manner that, when viewed from the ends, a line extending from each planar interface of the blocks passes directly through the axis of the feed screw rotor. This positioning of the sliding bearing surfaces allows the screw housing to move or expand axially and radially, due to thermal and pressure expansion of the housing, without displacing the center line of the feed screw. An important feature of the present invention is that by having a line projecting from the sliding bearing interface directly through the feed screw center line, any amount of radial expansion of the screw housing can take place without distorting the feed screw center.

Without the sliding surfaces oriented in this angled arrangement, the slides would have to be positioned directly on the horizontal center line of the feed screw housing to compensate for any expansion from the feed screw horizontal center line to the base or bottom of the feed screw housing. If the slides were thus positioned on the horizontal center line, as has been the conventional practice, then a side inlet screw or ribbon feeder could not be economically built and still compensate for all expansion of the screw housing.

BRIEF DESCRIPTION OF THE DRAWINGS

These and other features and advantages of the invention will be described more fully below with reference to the accompanying drawings, in which.

DESCRIPTION OF THE PREFERRED EMBODIMENT

Figure 1:
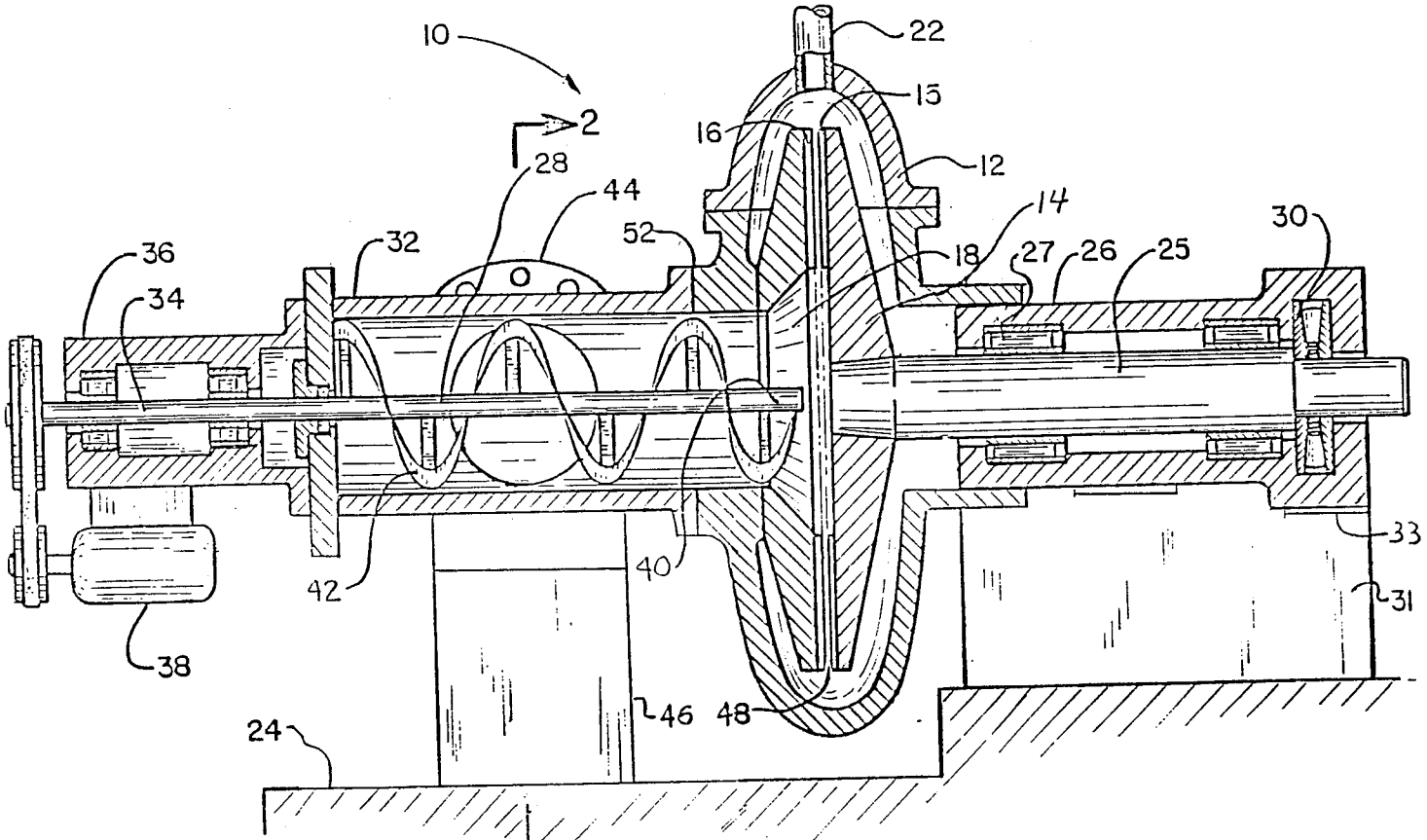
FIG. 1 is a schematic side elevation view of a disc refiner system in accordance with the invention.

FIG. 1 shows a typical disc refiner system 10 used in the paper pulp processing industries and the like. In such systems, a refiner casing 12 encloses a rotating disc 14, to which may be fitted specially patterned disc plates 15, which are maintained in spaced relation from an adjacent set of annularly disposed, stationary plates 16. The material to be refined is introduced near the axis of the rotating disc between the opposing plate surfaces, as at 18. The relative rotation of the plates centrifugally advances the material radially across the plate surfaces and the relatively close spacing of the plates breaks down the material fibers. The processed fibers are then extracted through a conduit 22 located at the circumference of the casing 12. The rotating disc 14 concentrically extends from the disc rotor 25, which is supported within a refiner bearing assembly 26 by roller bearings 27 and thrust bearing 30. Typically, the casing 12 is rigidly connected to the refiner base 31 and the bearing assembly 26 is supported by the refiner base on pads 33 that enable the bearing assembly to slide axially for the purpose of adjusting the plate separation. The overall arrangement of the refiner is exemplified by U.S. Pat. No. 4,725,336 (Fisher) "Refiner Apparatus With Integral Steam Separators", the disclosure of which is hereby incorporated by reference.

In the illustrated refiner system, a pulp feeder rotor 28 penetrates the casing and is centrally disposed within an elongated, substantially cylindrical feeder housing 32 coaxially extending opposite the refiner rotor 25. The housing is bolted to the casing through flange connection 52. At its end 34 opposite the disc 14, the rotor 28 is supported in a bearing assembly 36 that is connected to housing 32, and is rotated by means of a drive motor assembly shown generally at 38, the drive assembly including a motor, gearing, and the like, which, for purposes of the present invention, is conventional. The other end 40 of rotor 28 is cantilevered in the housing 32 to a position substantially adjacent to the center of the rotating disc 14 in the casing 12. The rotor 28 has connected thereto, a pattern of ribbon screw projections 42 for conveying pulp to the center of the rotating disc 14 in the casing. An infeed stock conveyor 44 is connected to the housing 32 to supply feed pulp to the ribbon feed screw 42. A pedestal 46 is secured to floor 24 to support the weight of the housing 32, rotor 28, bearing assembly 36, and motor assembly 38. Thus, in the illustrated embodiment, the weight of the refiner casing 12 is suspended between the feeder support pedestal 46 and the refiner base assembly 31.

Those familiar with this technology can appreciate that a major objective assuring safe and trouble free operation of the system is the maintenance of the desired spacing 48 between the plates 15 on rotating disc 14, and the stationary plates 16. At least two operating conditions can adversely affect spacing. First, the differential expansion of the housing 32 relative to the casing 12, due to differences in operating temperature and pressure, can impose stresses on the casing through the rigid connection 52, that can affect the spacing. Secondly, stresses can arise from a variety of loads originating with the piping and other connections to the refiner system, e.g., from the infeed stock conveyor 44, the refiner discharge conduit 22, and from various lines which are fluidly connected to the system for various purposes known to those skilled in this art.

In accordance with the present invention the feed housing pedestal 46 is designed to permit relative horizontal (axial) movement of the housing 32 with respect to the casing 12. Differential stresses or loads on the housing and casing, are substantially accommodated by the pedestal and thus minimize the differential effect of the loads on the spacing between the rotating disc plates 15 and the stationary plates 16 in the refiner casing 12.

Figure 2:
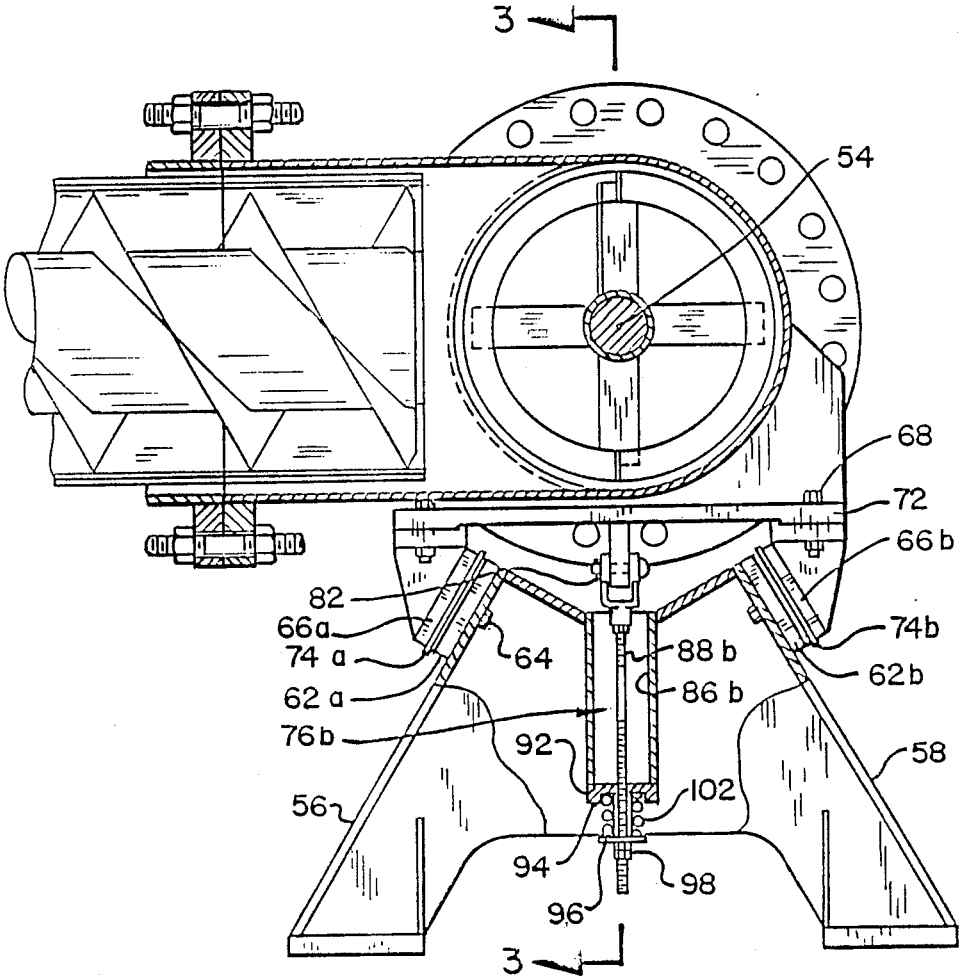
FIG. 2 is a section view taken along line 2—2 of FIG. 1, showing the feed screw oriented into the plane of the paper, and, in phantom, the screw type feed stock conveyor oriented from left to right.
Figure 3:
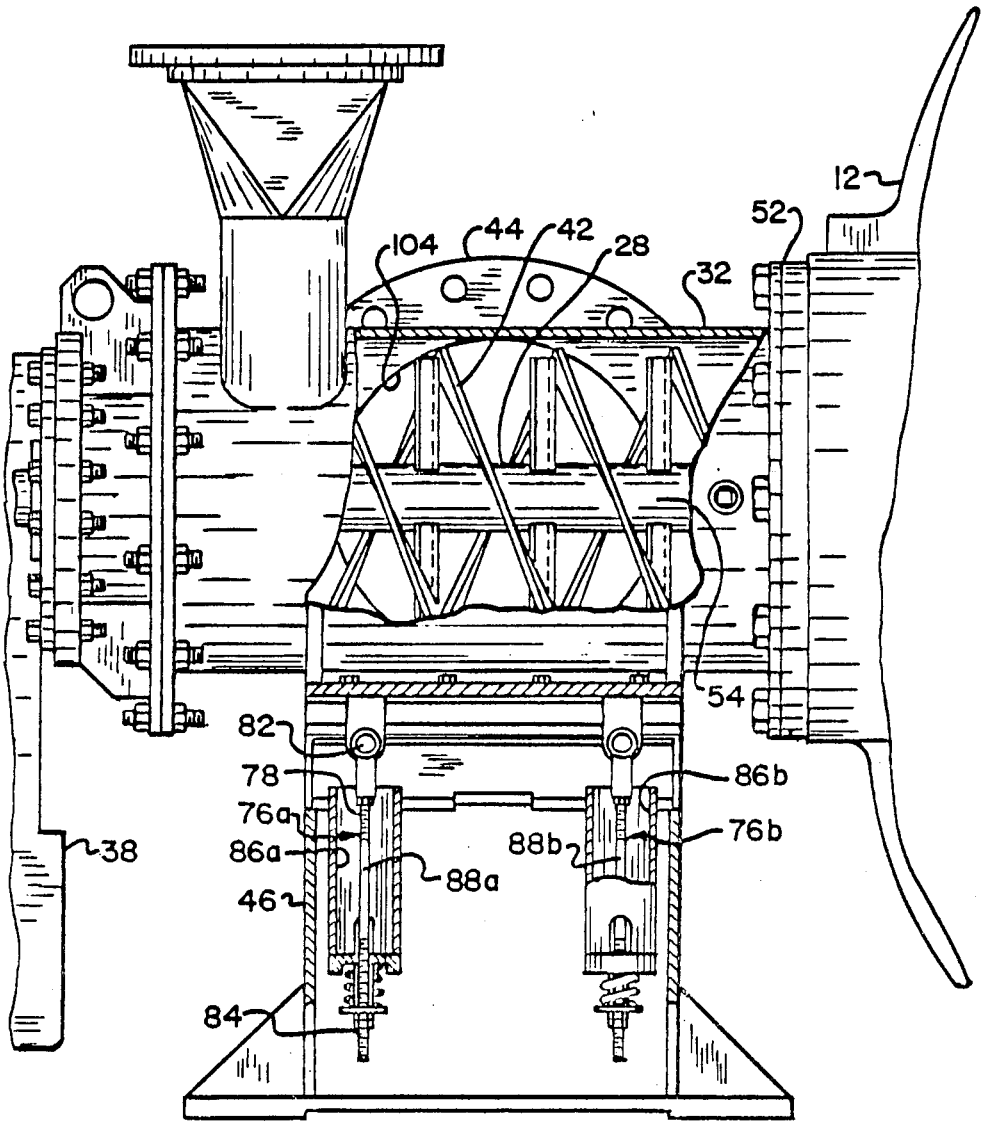
FIG. 3 is a section view taken along line 3—3 of FIG. 2.

FIGS. 2 and 3 illustrate the preferred embodiment of the invention. The pedestal 46 for the housing 32 is centrally positioned, substantially vertically below the rotor axis 54, and preferably has a shape resembling the letter "M" when viewed in section. Thus, the left and right side walls 56, 58 as shown in FIG. 2, are preferably angled at about 30° from the vertical. Near the upper portion of the side walls, are attached a respective pair of pedestal blocks **62*a*, 62*b*, each having a flat, planar surface which, if extended upwardly, would intersect and form an intersection line, substantially coincident with the rotor axis 54. The pedestal blocks 62*a*, 62*b* are preferably removably secured by means of bolts 64 or the like to the pedestal side walls, to facilitate replacement or refinishing of the planar surfaces. A second pair of blocks 66*a*, 66*b*, having flat, planar surfaces which are substantially coextensive with the first planar surfaces, are oriented downwardly and rigidly secured directly or indirectly to the housing 32, for transferring all of the weight associated with the housing 32 to the pedestal, through the pedestal blocks 62. The housing blocks 66 are preferably detachably connected, as by bolts 68, to a housing bracket 72**, which is in turn secured to the housing.

The mating surfaces 74 of the pedestal and housing blocks are preferably made of material which is rigid, yet permits a relative sliding between the surfaces, despite the considerable weight transmitted therethrough. It has been found that the preferred included angle of the sliding interfaces between the left and right pair of blocks **62*a*, 66*a*, and 62*b*, 66*b*, spans 60° and is vertically centered on the rotor axis. The choice of materials for the block contacting surfaces, and the vertical and horizontal dimensions of the contacting surfaces, can be optimized by the practitioner in accordance with the diameter of the feed housing 32, the available clearance between the feed housing and the floor 24**, and the weight to be supported. For example, the interfacing surfaces could be of the type described in U.S. Pat. No. 4,688,732, mentioned above, wherein one surface is made of chrome plated steel, while the other surface would be produced of steel having a teflon coating. Other options include glass reinforced teflon material with steel backing, or simply greased metal plates.

It should be appreciated that the support arrangement provided by these blocks permits horizontal movement of the housing 32 relative to the pedestal 46. Furthermore, as the housing may expand or contract, the dimensional change influences the effective radius of the housing, which is accommodated by the sliding of the blocks in a direction radially toward or away from the rotor axis 54. Ideally the housing 32 expands radially at the same rate as the casing 12.

As an additional feature of the present invention, two spring loaded tie rod assemblies **76*a*, 76*b* are positioned in the center of the pedestal 46, spaced apart vertically below the rotor axis 54. One end 78 of each rod is attached to the bottom of the housing, or the bracket 72, by a clevis joint 82, and the other end 84 extends vertically through the pedestal and is attached thereto to produce a resilient, tensioned force tending to maintain the housing blocks 66 in contact with the pedestal blocks 62. In the illustrated embodiment, the pedestal 46 has two vertically oriented chambers 86*a*, 86*b* through which the intermediate portions 88*a*, 88*b* of the tie rods pass, respectively. The lower end 92 of each chamber includes a spring seat 94 which cooperates with a washer 96 and nut 98 arrangement outside the chamber, for maintaining a coil spring 102 in compression to provide the tension bias on the tie rod 76**.

The tension force supplied to the tie rods resists any moment loading caused by any expansion forces applied to the side inlet conveyor nozzle 44 (the opening of which is shown at 104), or any other side forces applied to the feed screw housing 32 which would have a tendency to rotate the housing 32 about the bearing pedestal blocks **62*a*, 62*b*. The tie rod assemblies 76*a*, 76*b* also resist any moment loading produced by frictional resistance of the sliding blocks 62, 66 as the screw housing 62** moves axially.

I claim:

1. In a disc-type refiner system having a refiner casing, a disc mounted for rotation within the casing, an elongated feed housing rigidly attached to one side of the casing, a rotor supported along an axis within the feed housing for supplying feed material to the disc, a pedestal situated under the housing for supporting the housing, and a base for supporting the casing, the improvement comprising:

a pair of pedestal bearing blocks attached to the pedestal and having a respective first pair of planar surfaces oriented obliquely upward at equal angles to the vertical such that the axis of the rotor lies on the intersection of the first planar surfaces, if extended;

a pair of housing bearing blocks attached to the housing and having a respective second pair of planar surfaces oriented obliquely downward in contact with the first pair of planar surfaces for transferring the weight of the housing to the bearing blocks, said first and second pairs of planar surfaces being adapted to permit coplanar relative motion; and means for biasing the second planar surfaces into contact with the first planar surfaces.

2. The refiner system of claim 1, wherein the first and second planar surfaces are oriented at an angle of approximately 30° relative to the vertical.

3. The refiner system of claim 1, wherein the means for biasing the second pair of planar surfaces into contact with the first pair of planar surfaces, includes means connected in tension between the housing and the pedestal, for restraining movement of the housing relative to the pedestal.

4. The refiner system of 3, wherein the means for restraining includes a tie rod assembly connected between the housing and the pedestal, for resisting vertical and horizontal displacement of the housing relative to the pedestal.

5. The refiner system of claim 4, wherein said tie rod assembly includes a tie rod having one end attached to the housing through a clevis joint and the other end connected under a tension preload to the pedestal.

6. The refiner system of claim 5, wherein the pedestal includes a substantially vertically oriented central chamber, and wherein a portion of the tie rod between the clevis joint and said one end attached to the pedestal, passes vertically through the chamber with horizontal clearance.

7. The refiner system of claim 1 further including a bracket rigidly attached to the housing, immediately above the pedestal, and wherein said housing blocks are rigidly connected to the bracket such that the weight of the housing is transmitted through said bracket and housing blocks to the pedestal blocks.

8. The refiner system of claim 7, wherein said means for biasing the second planar surfaces into contact with the first planar surfaces includes a tie rod assembly having one end attached to the bracket and another end attached under biased tension to the pedestal, the tie rod assembly being in substantial vertical alignment with the rotor axis.

9. The refiner system of claim 8, wherein said pedestal includes a substantially vertically oriented chamber, and wherein a portion of the tie rod assembly passes through said chamber with horizontal clearance.

10. The refiner system of claim 8, wherein the tie rod assembly includes two spaced apart tie rods, each connected at one end to the bracket and the other end to the pedestal, both said tie rods being spaced apart in vertical alignment with the rotor axis.

11. The refiner system of claim 1, wherein the rotor is supported within the housing so that one end is supported by rotor bearings and the other end is cantilevered into the casing.

12. In a disc-type refiner system, a support arrangement for an elongated, substantially stationary horizontal housing containing a rotor supported within the housing for supplying feed material to a disc, comprising:

a stationary pedestal situated under the housing;

a first pair of bearing surfaces associated with the pedestal and oriented obliquely upward at equal angles to the vertical;

a second pair of bearing surfaces associated with the housing and oriented obliquely downward in contact with the first pair of bearing surfaces, said first and second bearing surfaces being adapted to permit limited relative sliding motion; and means for biasing the second pair of bearing surfaces into contact with the first pair of bearing surfaces.

13. The support arrangement of claim 12, wherein the first and second bearing surfaces are oriented at an angle of approximately 30° relative to the vertical.

14. The support arrangement of claim 12, wherein the means for maintaining the second pair of bearing surfaces in contact with the first pair of bearing surfaces, includes means connected in tension between the housing and the pedestal, for restraining movement of the housing relative to the pedestal.

15. The support arrangement of claim 14, wherein the means for restraining includes a tie rod assembly connected between the housing and the pedestal, for resisting vertical and horizontal displacement of the housing relative to the pedestal.

16. The support arrangement of claim 15, wherein said tie rod assembly includes a tie rod having one end attached to the housing through a clevis joint and the other end connected under a tension preload to the pedestal.

17. The support arrangement of claim 16, wherein the pedestal includes a substantially vertically oriented central chamber, and wherein a portion of the tie rod between the clevis joint and said one end attached to the pedestal, passes vertically through the chamber with horizontal clearance.

18. The support arrangement of claim 12 further including a bracket rigidly attached to the housing, immediately above the pedestal, and wherein said second pair of bearing surfaces are formed on a respective pair of housing blocks which are rigidly connected to the bracket such that the weight of the housing is transmitted through said bracket and housing blocks to the first pair of bearing surfaces, which are formed on a respective pair of pedestal blocks carried by the pedestal.

* * * * *